United States Patent [19]

Genevois et al.

[11] 4,243,381

[45] Jan. 6, 1981

[54] CONTINUOUS RING FURNACES

[76] Inventors: Jean L. Genevois, Corso Sempione 3, Milano; Presti Paolo, Via della Balduina 133, Roma; Giuseppe De Stefani, Via Novara, 55, Abbiategrasso, all of Italy

[21] Appl. No.: 24,566

[22] Filed: Mar. 28, 1979

[30] Foreign Application Priority Data

Mar. 30, 1978 [IT] Italy ..... 48681 A/78

[51] Int. Cl.[3] ..... F27D 23/00

[52] U.S. Cl. ..... 432/75; 432/118; 137/340; 134/5; 134/105

[58] Field of Search ..... 432/67–71, 432/75, 2; 134/166 C, 5, 105; 137/15, 340, 341, 238; 138/35

[56] References Cited

U.S. PATENT DOCUMENTS

| | | | |
|---|---|---|---|
| 824,570 | 6/1906 | Myser et al. | 52/16 |
| 942,337 | 12/1909 | Moore | 138/35 |
| 1,117,814 | 11/1914 | Dutton | 432/2 |
| 2,452,367 | 10/1948 | Gangloff | 134/5 |
| 3,102,055 | 8/1963 | Faigen et al. | 134/5 |
| 3,174,491 | 3/1965 | Faler | 134/105 |
| 3,271,018 | 9/1966 | Reaney et al. | 432/118 |
| 3,274,700 | 9/1966 | Maguire, Sr. et al. | 134/105 |
| 3,275,803 | 9/1966 | True | 138/35 |
| 3,777,502 | 12/1973 | Michie et al. | 137/340 |

*Primary Examiner*—Henry C. Yuen

*Attorney, Agent, or Firm*—DeLio and Montgomery

[57] ABSTRACT

A smoke conducting apparatus for use particularly with continuous ring furnaces (e.g., Hoffman furnaces) wherein each furnace chamber is connected to the smoke channel, the latter being a metal pipe inclined slightly from horizontal and provided with one or more traps along the length of its bottom surface, each trap containing a removable receptacle, and heating means being disposed along the bottom of the channel to fluidize tarry deposits of combustion products so that such deposits will flow by gravity into the removable receptacle.

4 Claims, 3 Drawing Figures

CONTINUOUS RING FURNACES

This invention refers to a new type of smoke channel of the continuous ring furnaces, also called Hoffman furnaces, for baking and rebaking carbon articles.

Hoffman furnaces comprise a number of channels connected to each other to form an elongated endless ring or loop and connected in turn also to an annular channel, common to all the chambers. receiving the hot gases or smoke therefrom which are to be discharged from the chimney after having flowed through the channels.

These hot gases are saturated with tar vapours tending to condense and, accordingly, to form deposits which, in the long run, can plug the channels, owing to the progressive gas cooling that inevitably occurs, more or less, even within the most insulated channels.

Furthermore, since the channels are a building structure actually made of refractory bricks, they comprise very rough walls exerting a "grip" on the deposits which thus flow with difficulty within the channels.

Finally, the refractory bricks "release" chips of refractory material to the deposits, thus preventing a further use thereof as a fuel.

It is evident that the plugging of the channels is a serious drawback and the necessary periodical cleaning of these channels is a time-requiring and costly operation.

Accordingly, it is a general object of the invention to provide a new and improved smoke channel wherein the drawback of plugging due to the tar deposits condensed from the smoke flowing in the furnace is substantially overcome.

It is another object of the invention to provide a smoke channel comprising means for preventing the tar condensate from cooling down and then solidifying.

Finally, it is a further object of the invention to provide a smoke channel that does not release extraneous particles to the deposits formed therein.

According to the invention, the smoke channel comprises a metal pipe of large diameter having an outer insulating lining and inclined to allow the tar condensate to flow towards outlets in the lower part of the pipe.

Furthermore, a tube of small cross section is arranged in the lower part of the metal pipe. A heated fluid flows in this tube to prevent the tar condensate from cooling and, accordingly, solidifying.

With the above-described structure and solutions and by placing extractable containers at the outlets, the smoke channel according to the invention is completely free from the drawbacks and inconveniences of the smoke channels used heretofore.

The invention will be now described in detail with reference to the annexed drawings, wherein.

Figure 2:
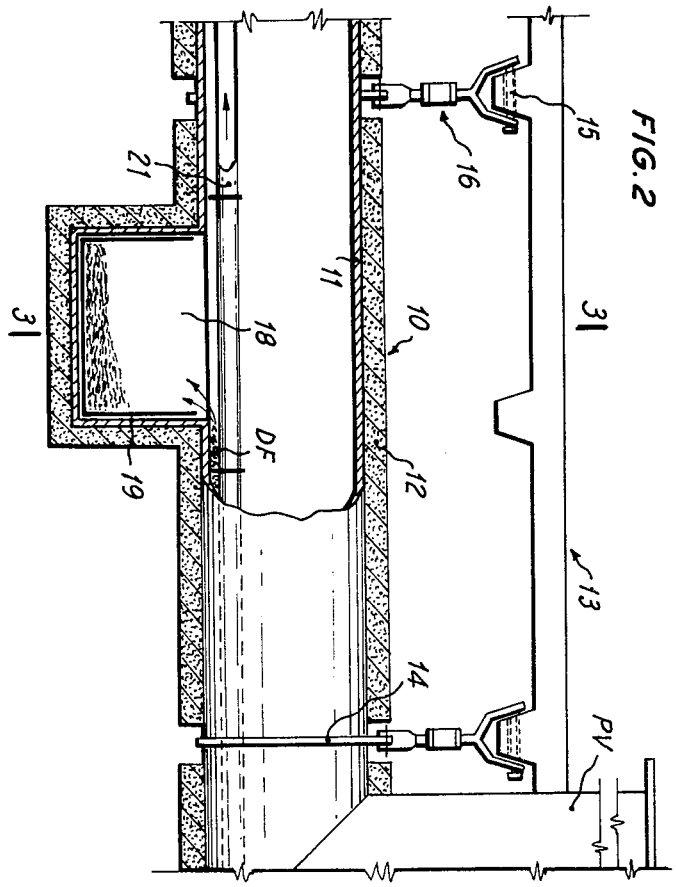
FIG. 2 is an enlarged vertical detail longitudinal section of a shorter length of the channel of FIG. 1, with parts cutaway to show the interior thereof.
Figure 1:
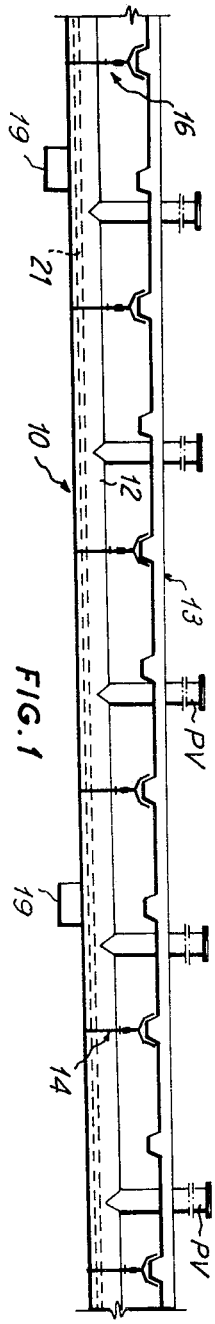
FIG. 1 is a somewhat diagrammatic elevation of a length of the improved smoke channel according to the invention.
Figure 3:
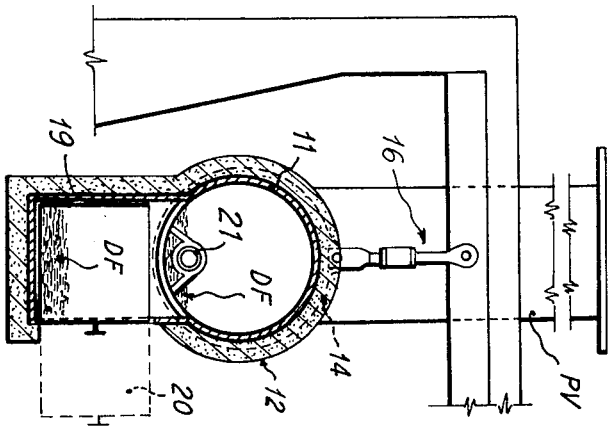
FIG. 3 is a sectional view along lines 3—3 of FIG. 2.

As clearly shown in FIGS. 2 and 3, the improved smoke channel, generically indicated by 10, comprises a metal pipe 11 of large diameter, having an outer lining 12 of insulating material.

Pipe 11 is held at a certain height with respect to the ground surface level, and at a slight inclination thereto, by means of an elongated supporting element 13, preferably made of reinforced concrete, through rings 14 connected to ribs 15 of support 13 by tie-rods 16. Vertical passages PV protrude upwardly from pipe 11 intended for connection of pipe 11 with each chamber (not shown) of the furnace, which chambers are arranged parallel to pipe 11.

Furthermore, the bottom of pipe 11 is provided with uniformly spaced openings 18, communicating with corresponding tanks 19 which are secured to the outer wall of pipe 11, and receive extractable containers 20 therein.

Finally, a tube 21 of small cross section runs along the bottom of large diameter pipe 11 and a heated fluid, such as vapour, supplied by a suitable source is caused to flow within tube 21.

It will be evident to those skilled in the art that such a structure is completely free from the above-mentioned inconveniences.

As a matter of fact, the tar condensate that inevitably deposits in channel 10, due to the smoke cooling occurring therein, will readily flow downwardly along the wall of pipe 11, that is of a very smooth nature, and will deposit on the bottom of pipe 11, as clearly indicated by DF in FIGS. 2 and 3.

On the bottom of pipe 11, deposit DF will be maintained in the fluid state, owing to the heat released by the heated fluid flowing in tube 21. Accordingly, due to the inclination of pipe 11, deposit DF reaches downstream opening 18 and discharges into extractable container 20, from which it can be easily recovered.

From the foregoing it is evident that the improvement according to the invention can be also applied to the smoke channels already existing, limitedly to the positioning of a tube having a reduced cross section, wherein a heated fluid flows, along the bottom of the channel in order to maintain the tar deposits formed therein in a fluid state, and the discharging of these deposits to suitable containers, through suitable outlets.

From the foregoing it is evident that the invention fully attains the above-described objects.

Finally, it is to be understood that modifications and changes can be made to the illustrated and described structure without departing from the concepts and spirit of the invention. The heated fluid, for example, can flow in a cavity of the channel, instead of flowing along a tube received therein, and so on.

We claim:

1. Smoke cleaning apparatus for use with a fuel-burning furnace, comprising an elongated tubular smoke channel, means supporting said channel in a position slightly inclined from the horizontal, means connecting the apparatus to a source of products of combustion and heating means in the lower part of the channel adapted to fluidize combustion products deposited therein, whereby said products may flow along the channel, the smoke channel is provided with at least one spaced outlet in its bottom to permit outward passage of said fluidized products, a tank integral with the channel being associated with each outlet and a removable container being fitted within each tank to receive said fluidized deposits.

2. Smoke cleaning apparatus according to claim 1 wherein the furnace in a Hoffman-type multi-chamber furnace and the connecting means comprise passages connecting each chamber with the smoke channel.

3. Smoke cleaning apparatus according to claim 1 or 2 wherein said smoke channel comprises a metal pipe of large diameter supported at a certain height above ground level and provided with an outer layer of heat insulating material.

4. Smoke cleaning apparatus according to claim 1 or 2 wherein the heating means is a pipe of relatively small cross-section disposed along the lower part of the channel and connected to a source of hot fluid.

* * * * *